US005613574A

United States Patent [19]

Melanson

[11] Patent Number: 5,613,574

[45] Date of Patent: Mar. 25, 1997

[54] LADDER MOUNTED TOOL HOLSTER AND PARTS TRAY

[76] Inventor: Charles J. Melanson, 1025 Staghorn St., West Palm Beach, Fla. 33414

[21] Appl. No.: 494,088

[22] Filed: Jun. 23, 1995

[51] Int. Cl.[6] ..... E06C 7/14

[52] U.S. Cl. ..... 182/129; 248/238

[58] Field of Search ..... 182/129; 248/238, 248/210

[56] References Cited

U.S. PATENT DOCUMENTS

| | | | |
|---|---|---|---|
| 3,042,142 | 7/1962 | Butler | 182/129 |
| 4,261,435 | 4/1981 | Winter | 182/129 |
| 4,383,669 | 5/1983 | Rasler | 248/210 |
| 4,874,147 | 10/1989 | Ory | 248/210 |
| 4,949,925 | 8/1990 | Gorecki | 182/129 X |
| 5,093,052 | 3/1992 | Beck | 248/238 |
| 5,342,008 | 8/1994 | Kay | 248/238 |

FOREIGN PATENT DOCUMENTS

| | | | |
|---|---|---|---|
| 2193523 | 2/1988 | United Kingdom | 182/129 |

*Primary Examiner*—Alvin C. Chin-Shue
*Attorney, Agent, or Firm*—Alvin S. Blum

[57] ABSTRACT

A combined compartmented tray and tool holster is arranged to removably clamp onto the top step of a stepladder. The tool holster presents the tool to one side of the ladder or the other as desired. An opening at the bottom of the holster permits passage therethrough of the end of the tool with any tool bit attached thereto. The tool handle rests securely in ready reach of the worker without fear of dropping the tool, while both hands are free when required. Items in the compartments are also within ease reach and view of the worker. The clamping system for clamping the device to the top step is adjustable to steps of various thicknesses.

2 Claims, 1 Drawing Sheet

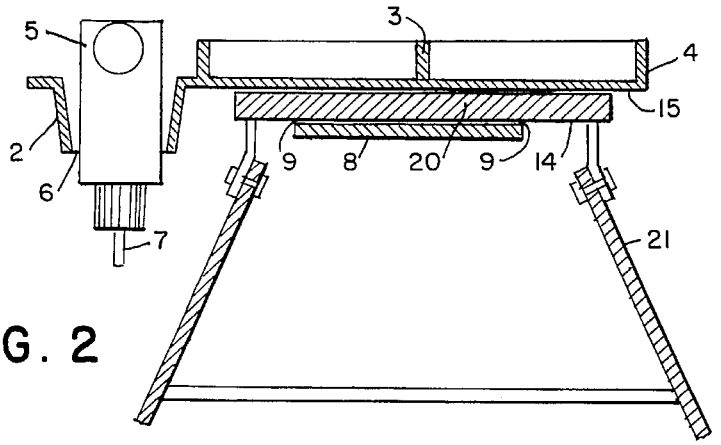
FIG. 2
FIG. 6
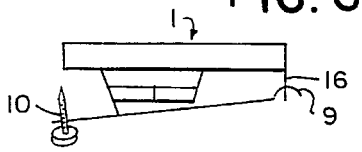
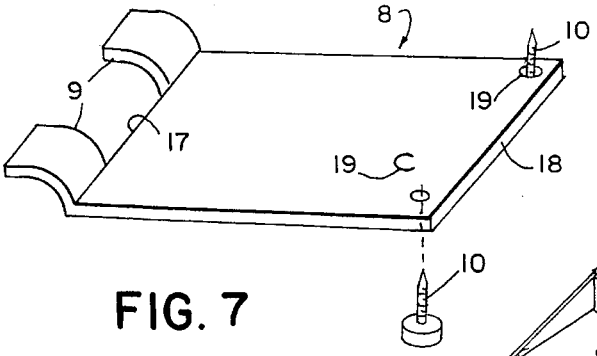
FIG. 7
FIG. 1
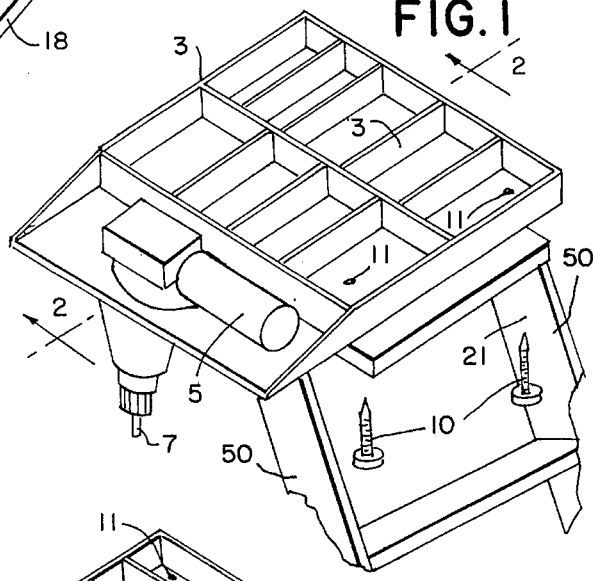
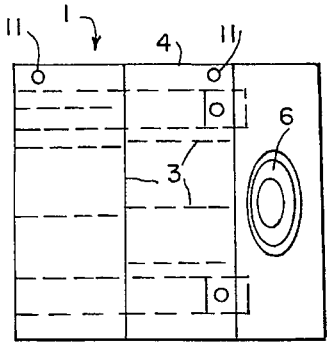
FIG. 4
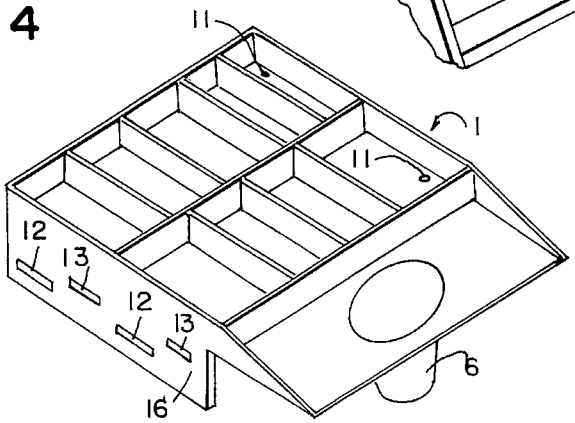
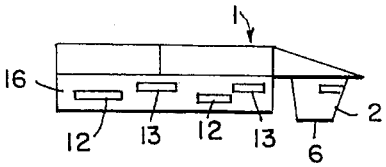
FIG. 5
FIG. 3

LADDER MOUNTED TOOL HOLSTER AND PARTS TRAY

BACKGROUND OF THE INVENTION

This invention relates to accessories for stepladders, and more particularly to a parts tray combined with a tool holster for removably attaching to the top of a stepladder.

When working on a stepladder, it is often desirable for a worker to have a convenient place to store various items such as small parts, fasteners, liquid containers, brushes and the like in a readily accessible location. The top level of the stepladder is a most convenient location.

U.S. Pat. No. 4,874,147 issued Oct. 17, 1989 to Ory discloses a solution to the problem and discusses the relevant prior patent literature.

Another problem encountered by the worker on the ladder not considered by the prior art relates to a heavy tool such as an electric drill or screwdriver that might be employed while on the ladder. Chucked up in the tool may be a drill bit or screwdriver bit that is delicate and expensive. It is often necessary to lay the tool aside while working. If this is laid on the ladder or a tray, it may be dislodged and fall to the floor, frequently damaging the bit and sometimes damaging the tool. The worker must in any case climb down to retrieve the tool and the work may be interrupted while a replacement is acquired.

SUMMARY OF THE INVENTION

It is accordingly an object of the invention to provide a removable device readily adapted to mount upon the top of a ladder that will hold a plurality of different items for ready access in combination with a secure support or holster for a tool such that a worker can easily grasp the handle and lift the tool out of its holster ready for use in much the same fashion as a gun holster. It is another object that the device be mountable on a variety of ladders having different top step thicknesses and be adjustably mountable such that the tool is presented to either the left hand or the right hand of a worker.

The device of the invention comprises a compartmented tray having an open top adapted for clamping onto the top step of a stepladder. A tool holster having an open bottom for passage of the nose of the tool and any bit therethrough is on one side of the tray. Clamping means that passes under the tray securely clamps the tray in place with the holster to one side. The tray may be reversed on the ladder so that the holster is either on the left or the right side of the ladder as desired.

These and other objects, features and advantages of the invention will become more apparent when the detailed description is studied in conjunction with the drawings.

BRIEF DESCRIPTION OF THE DRAWINGS

FIG. 1 is a perspective view of the invention clamped on the top step of a stepladder.

FIG. 2 is a sectional view taken through line 2—2 of FIG. 1.

FIG. 3 is a perspective view of the invention rotated 90° from FIG. 1.

FIG. 4 is a top plan view of the invention.

FIG. 5 is a front elevation view of the invention.

FIG. 6 is a side elevation view of the invention.

FIG. 7 is a perspective view of the clamping element of the invention.

DETAILED DESCRIPTION OF PREFERRED EMBODIMENTS

Referring now first to FIGS. 1 and 2, the combined holster 2, and tray 4 with compartment partitions 3 is molded in a single unit 1 of plastic. The holster 2 is conical with a lowermost opening 6 to enable the tool bit 7 attached to the end of the tool to pass therethrough while the tool handle 5 rests in easy grasp of the worker. The combination 1 is shown clamped onto the top step 20 of stepladder 21 such that the tool will be on the left side of the worker, for easy grasping by the left hand. When the worker prefers the tool at the right side, the combination is unclamped, rotated 180° and reclamped. This invention adapts a stepladder to the convenience of having many open top compartments for holding a variety of items conveniently positioned before the worker. The worker may release the tool to have both hands free and yet have the tool immediately at hand as needed without fear of dropping and damaging valuable equipment.

Because these tools have considerable weight and overhang the step, it is important that the combination be securely clamped in place. As best seen in FIG. 7, a clamping plate 8 is provided at a first end 17 with prongs 9, and at a second end 18 with threaded fasteners 10 held captive with clips 19.

As best seen in FIGS. 3–6 a vertical panel 16 extends downward from one side of the tray 4. It is provided with a first set of two apertures 12, and a second set of apertures 13. The apertures of either set are arranged to receive therethrough the prongs 9 of the clamping plate 8 when the flat underside 15 of the tray rests upon the top step 20 of the stepladder and the plate engages the underside 14 of the top step. The fasteners then threadably engage the tray through the holes 11 in the tray. By providing a second set of apertures at a different height, the clamping means is more readily adapted to top steps of different thicknesses.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts, and the specific manner of practicing the invention may be made within the underlying idea or principles of the invention within the scope of the appended claims.

What is claimed is:

1. A compartmented tray and tool holster combination for mounting atop a stepladder that has a top step, the combination comprising:

a compartmented tray having a flat underside arranged to lie flat in stable contact with a top step of a stepladder;

clamping means attached to the tray for securely clamping the tray selectively in one of two positions on the top step of the stepladder;

a tool holster attached to the tray, the holster having a tool receiving recess with an opening in the lowermost portion thereof to permit passage therethrough of a terminal portion of a tool while enabling the handle of the tool to rest uppermost for easy grasping by a worker, the tool holster attached to the tray at one of the lateral sides thereof and adapted to lie beyond the left side of the stepladder in a first of said two positions and beyond the right side of the stepladder in a second of said two positions;

said clamping means comprising a vertical panel attached to one side of the tray and extending downward therefrom;

a first set of at least two spaced apart apertures passing through said vertical panel;

a clamping plate having attached at a first end thereof a number of prongs equal to the number of said at least two apertures and arranged to engage said at least two apertures at a particular level, the clamping plate having fastener means at a second end opposite said first end, the fastener means arranged to engage the tray while a top step of a stepladder is sandwiched between the tray and the clamping plate with the prongs on one side of the top step and the fastener means on the other side of the top step.

2. The combination according to claim 1, in which said vertical panel is provided with a second set of at least two apertures for receiving the prongs at another level for clamping to a top plate having a different thickness.

* * * * *